United States Patent [19]

Ezure et al.

[11] Patent Number: 4,737,124

[45] **Date of Patent: * Apr. 12, 1988**

[54] CONNECTOR PLUG

[75] Inventors: Tadayoshi Ezure, Isesaki; Shigemi Sekiguchi, Kiryu, both of Japan

[73] Assignee: Hosiden Electronics Co., Ltd., Osaka, Japan

[ * ] Notice: The portion of the term of this patent subsequent to Aug. 4, 2004 has been disclaimed.

[21] Appl. No.: 52,942

[22] Filed: May 22, 1987

Related U.S. Application Data

[63] Continuation of Ser. No. 678,826, Feb. 5, 1986, Pat. No. 4,684,199.

[51] Int. Cl.[4] ..... H01R 13/506

[52] U.S. Cl. ..... 439/610; 439/585; 439/604; 439/695; 439/903

[58] Field of Search ..... 439/610, 607, 578, 753, 439/702, 449, 453, 451, 452, 455, 660, 190, 320, 557, 460, 604, 695, 903, 904, 585

[56] References Cited

U.S. PATENT DOCUMENTS

| | | | |
|---|---|---|---|
| 2,247,386 | 7/1941 | John | 439/320 |
| 2,712,119 | 6/1955 | Strubel | 439/453 |
| 2,874,366 | 2/1959 | Fromer | 439/753 |
| 3,986,765 | 10/1976 | Shaffer et al. | 439/449 |
| 4,557,545 | 12/1985 | Ohtsuki et al. | 439/607 |
| 4,634,208 | 1/1987 | Hall et al. | 439/610 |

*Primary Examiner*—Neil Abrams
*Attorney, Agent, or Firm*—Pollock, Vande Sande and Priddy

[57] ABSTRACT

A connector plug includes a plurality of contact pins carried by an insulating body which is installed in a cylindrical metal cover. The cylindrical metal cover has a semi-cylindrical rear portion which is engaged with a semi-cylindrical metal cover piece into a cylindrical form. A separtately molded insulating cap is assembled onto the cylindrical metal cover. Within the insulating cap, a cable clamp member having a thickness greater than that of the cylindrical metal cover is secured to a rear end extension of the cover. A cable connected to the contact pins is clampedly held by the cable clamp member.

1 Claim, 7 Drawing Sheets

CONNECTOR PLUG

This is a continuation of Ser. No. 826,464, filed on Feb. 5, 1986 now U.S. Pat. No. 4,684,199.

BACKGROUND OF THE INVENTION

This invention relates to a connector plug used for interconnection of audio-equipments, video-equipments, personal computers and their peripheral equipments.

A connector plug has been proposed in Japanese Utility Model Publication No. 59-79986, entitled "Connector Plug," which has two features. One of the features is that although the plug is small in size, it can provide a strong force, with which it is held fitted in a connector socket, and offer a strong resistance against a force tending to pull it out of the socket so that it is less liable to be accidentally detached from the socket. The other feature is that although it is small in size, it permits ready positioning of pins when it is inserted into the connector socket.

The structure of this prior art connector plug will now be described with reference to FIGS. 1 to 6. FIG. 1 shows a perspective view of the connector plug. It comprises a cylindrical metal cover 101, which accommodates an insulating body 102 fitted into it. A plurality of contact pins 103 extend through insulating body 102 in the axial direction of cylindrical metal cover 101. This example of the connector plug has five contact pins 103. Metal cover 101 is covered by an insulating cap 104 except for its front portion. Insulating cap 104 has a rear cable protector portion 105, through which a cable 300 is led out from metal cover 101.

This prior art connector plug structure has two features. One of the features is that metal cover 101 is cylindrical. The other feature is that a front portion of metal cover 101 has a main positioning ridge 106 and a plurality of auxiliary positioning ridges 107*a* and 107*b*, these ridges protruding radially inwardly from the inner cylindrical surface of metal cover 101. Main positioning ridge 106 is distinguished from auxiliary positioning ridges 107*a* and 107*b* by its shape and size. Main positioning ridge has a greater circumferential width dimension and a greater height than auxiliary positioning ridges 107*a* and 107*b*. Due to this difference in shape, main positioning ridge 106 is prevented from being engaged in a recess or groove on the socket side, in which auxiliary positioning ridge 107*a* and 107*b* is to be engaged. The plug thus can be inserted in a fixed orientation.

The front ends of main and auxiliary positioning ridges 106, 107*a* and 107*b* are offset a fixed distance L from the front end of cylindrical metal cover 101. Cylindrical metal cover 101 has a cut-away part 108 open at its front end. Cut-away part 108 is provided for avoiding engagement of the plug with a portion of the socket and permits size reduction of the socket.

Insulating body 102 has an insulating bar-like member 109 integrally extending forwardly from the front end thereof together with contact pins 103. Insulating bar-like member 109 is provided at different positions according to the number of contact pins 103 provided in insulating body 102. FIGS. 2 to 4 show connector plugs having different numbers of pins 103. Insulating bar-like member 109 is provided at different positions in the front end of these connector plugs. The connector plug shown in FIG. 2 has three pins. The connector plug shown in FIG. 3 has four pins. The connector plug shown in FIG. 4 has eight pins. In these examples, eight pins are the maximum number of pins that are carried together. With the connector plug having the maximum number of pins, insulating bar-like member 109 is omitted. That is, insulating bar-like member 109 is provided on only the connector plugs having three to seven pins.

The mating socket is provided with a hole, in which insulating bar-like member 109 is to be received. The positional relation between insulating bar-like member 109 and the socket hole prevents erroneous insertion of a plug into a socket for a plug having a different number of pins. Insulating bar-like member 109 has a slightly greater length than contact pins 103, by which it extends from insulating body 102, than contact pins 103. Thus, it is only when insulating bar-like member 109 is first inserted into the corresponding hole in the socket that contact pins 103 can then be inserted into corresponding contact pin holes in the socket.

FIG. 5 shows the internal structure of the prior art connector plug. Contact pins 103 are preliminarily planted, for instance by forced piercing, in insulating body 102 such that their contact portions project from the front end of insulating body 102 and their connecting terminal portions project from the rear end of insulating body 102. Insulating body 102 with contact pins 103 is inserted into cylindrical metal cover 101 from the rear end thereof. Wires of cable 300 are preliminarily soldered to the connecting terminal portions of corresponding contact pins 103 projecting from the rear end of insulating body 102.

Cylindrical metal cover 101 is formed by pressing a resilient metal sheet into a cylindrical form. The opposite edges of the metal sheet are free edges to permit resilient deformation of the cover in the diametrical direction. Cylindrical metal cover 101 has a plurality of protuberances 301 projecting from the inner peripheral surface thereof. These protuberances 301 are adapted to be received in recesses 302 formed in the outer periphery of insulating body 102 when insulating body 102 is inserted into cylindrical metal cover 101.

When insulating body 102 is inserted until protuberances 301 are engaged in recesses 302 of insulating body 102, inwardly bent portions 303 of cylindrical metal cover 101 formed rearwardly of protuberances 301 are engaged in recesses 304 formed in insulating body 102 at the circumferential edge adjacent to the rear end. Insulating body 102 thus is locked in cylindrical metal cover 101 by protuberances 301 and bent portions 303.

Cylindrical metal cover 101 has a cable clamp 305 extending from its rear end. Cable clamp 305 consists of an arcuate clamp portion 306 and a connecting portion 307 connecting clamp portion 306 and the rear end of cylindrical metal cover 101. Clamp portion 306 has a plurality of inner teeth 308.

After insulating body 102 has been installed in cylindrical metal cover 101, clamp portion 306 of cable clamp 305 is bent inwardly to wedge it into the insulating cover of cable 300. Cable 300 is secured to cylindrical metal cover 101 with the wedging of teeth 308 of clamp portion 305 into the insulating sheath of cable 300.

After cable 300 has been secured by cable clamp 305 to cylindrical metal cover 101, the cylindrical metal cover with insulating body 102 is set in a mold for resin molding to form insulating cap 104 integrated with cable protector portion 105, as shown in FIG. 6. During the resin molding of insulating cap 104 and cable protector portion 105, the resin intrudes into the interior of cylindrical metal cover 101 through openings 309 or windows that are formed when forming inwardly bent portions 303, whereby cylindrical metal cover 101 and cable 300 are molded into insulating cap 104 and cable protector portion 105.

This prior art connector plug has the following advantages.

(a) Since metal cover 101 is formed by bending a metal sheet into a cylindrical form (unlike a still earlier prior art connector plug where a cylindrical metal cover was assembled from two semi-cylindrical halves), the resiliency of the cylindrical metal cover in the diametrical direction can be increased. It is thus possible to provide a connector plug which can be held fitted in a mating connector socket, and which offsets a strong resistance against a force tending to pull it out from the socket.

(b) Since the connector plug has main positioning ridge 106 and two or more auxiliary positioning ridges 107*a* and 107*b*, when the end portion of cylindrical metal cover 101 is inserted into an annular groove of the mating connector socket, these ridges 106, 107*a* and 107*b* are engaged with the cylindrical wall defining the annular groove, whereby the plug is supported. Therefore, for finding the inserting position of the plug, the plug can be turned without being inclined, i.e., with its axis coincident with the axis of the connector socket. Thus, the operation of finding the plug insertion position can be facilitated.

(c) The provision of insulating bar-like member 109 assures that the plug cannot be inserted into the socket unless the contact pins of the plug corresponds in number to the pin insertion holes of the socket. Therefore, there is no possibility of erroneous insertion of a plug into a socket which is provided for a plug having a different number of pins. Erroneous electric connection thus can be prevented. Further, the engagement of insulating bar-like member 109 in the corresponding hole in the socket helps to support the plug in the socket without rattling.

With the plug having eight contact pins, the eighth contact pin 103*h* (as shown in FIG. 4) is provided at a position different from the position of insulating bar-like member 109 of a connector plug having a different number of pins. Therefore, even without insulating bar-like member 109, the plug will never be erroneously inserted into a connector socket for a plug having a different number of pins, particularly the plug having seven pins.

(d) Since insulating bar-like member 109 extends a slightly greater distance from the insulating body than contact pins 103, contact pins 103 will never be inserted into contact pin holes of the socket unless insulating bar-like member 109 is first inserted into its corresponding hole in the socket. Thus, a two-fold positioning can be obtained, i.e., one positioning function is provided by positioning ridges 106, 107*a* and 107*b* and the other positioning function is provided by insulating bar-like member 109. This has an effect of preventing the erroneous contact of a contact pin of a plug with a contact of an irrelevant circuit on the socket side when an attempt is made to find the proper inserting position of the plug.

(e) In the internal structure, arcuate clamp portion 306, which constitutes a portion of cable clamp 305 and has inner teeth 308, is bent to close the corresponding end of cylindrical metal cover 101, thereby causing teeth 308 to wedge into the insulating sheath of cable 300. The length of the plug thus can be reduced compared to prior art plugs having different cable clamp structures.

With this connector plug, however, insulating body 102, to which cable 300 is connected, is inserted comparatively deeply into cylindrical metal cover 101. This operation is rather cumbersome. In addition, the plug is manufactured by connecting cable 300 to contact pins 103 extending from insulating body 102, then inserting insulating body 102 into cylindrical metal cover 101, then inserting the plug portion of cable 300, i.e., cylindrical metal cover 101 with insulating body 102 fitted therein, into a mold for resin molding to form insulating cap 104 with cable protector portion 105. Therefore, the manufacture is rather complicated. The operation of inserting cylindrical metal cover 101 with cable 300 connected thereto into the mold and setting it in a predetermined position in the mold is particularly cumbersome and requires considerable man-hour.

Further, since insulating cap 104 is molded to cover cylindrical metal cover 101, no repair can be done when cable 300 and a contact pin 103 become disconnected from each other.

Further, insulating cap 104, as shown in FIGS. 1 to 6, consists of a comparatively thin cover wall covering the outer periphery of cylindrical metal cover 101. Therefore, when a portion of insulating cap 104 near the front end is gripped, the gripping fingers are very liable to touch cylindrical metal cover 101 because of the small thickness of the wall of insulating cap 104. When cylindrical metal cover 101 is touched by a finger, any electric charge carried by the user's body is discharged to cylindrical metal cover 101. The discharge voltage is coupled through cable 300 to an input or output terminal connected thereto of an electronic apparatus. In such a case, rupture of a semiconductor element or the like connected to the terminal is liable to occur.

Further, while cable clamp 305 may permit size reduction of the plug, its mechanical strength is low because cylindrical metal cover 101 is made from a thin sheet material. Therefore, with this prior art connector plug it is necessary to reinforce cable clamp 305 by inserting a rear portion of cylindrical metal cover 101 inclusive of cable clamp 305 into a resin constituting insulating cap 104.

Further, in case of the still earlier connector plug which was provided prior to the prior art connector plug shown in FIGS. 1 to 6, the cylindrical metal cover was assembled from two semi-cylindrical halves as mentioned before. This connector plug, therefore, had the problems of loose mounting of the metal cover and inaccurate relative positioning between the two semi-cylindrical halves. To solve these problems, it has been necessary to increase the axial dimension or length of the insulating body. In addition, the metal cover should have a large wall thickness and a high mechanical strength. Further, it has been necessary to use an insulating cap having a large wall thickness in order to secure the assembly consisting of the insulating body and metal cover to the insulating cap. Therefore, the size of the whole plug has been inevitably large.

SUMMARY OF THE INVENTION

An object of the present invention is to provide a connector plug, which is small in size, permits easy mounting of an insulating body in a cylindrical metal cover and can provide a strong force for engagement with a mating connector socket.

Another object of the invention is to provide a connector plug, which is small in size, and can be easily assembled.

A further object of the invention is to provide a connector plug, in which the metal cover is less liable to be touched by a finger when it is gripped.

The connector plug according to the invention, has a structure substantially similar to the prior art connector plug shown in FIGS. 1 to 6 in respect to the shape of the front portion of the cylindrical metal cover and the shape of the insulating body. According to the invention, a rear portion of the cylindrical metal cover consists of a combination of a semi-circular rear portion and a separate semi-cylindrical metal cover piece. That is, the cylindrical metal cover has a semi-cylindrical rear portion defining a large side opening. The insulating body can be inserted into the cylindrical metal cover through this side opening, so that the manufacture can be very much simplified. In addition, a front portion of the metal cover has a cylindrical form consisting of a single metal sheet. Thus, even with a comparatively thin metal sheet it is possible to provide a strong force for engagement with the socket.

Further, according to the invention a separately fabricated insulating cap is fitted on a rear portion of the cylindrical metal cover. Therefore, the manufacture is simpler compared to the case of molding the insulating cap on the cylindrical metal cover with the cable connected thereto. In addition, the separate insulating cap may be produced using an automatic manufacturing machine. Further, with the separate insulating cap fitted on the cylindrical metal cover, in case a disconnection between cable wires and contact pins occurs, repair can be done by removing the insulating cap. The yield of production thus can be improved.

Still further, according to the invention a separately prepared cable clamp member is secured to the rear end of the semi-circular portion of the cylindrical metal cover, and the cable is clampedly held by this cable clamp member. The cable clamp member is made from a metal sheet having a greater thickness than the metal sheet of the cylindrical metal cover. Thus, it can clamp the cable with a strong clamping force.

DETAILED DESCRIPTION OF THE PREFERRED EMBODIMENT

An embodiment of the invention will now be described with reference to FIGS. 7 to 13.

Figure 1:
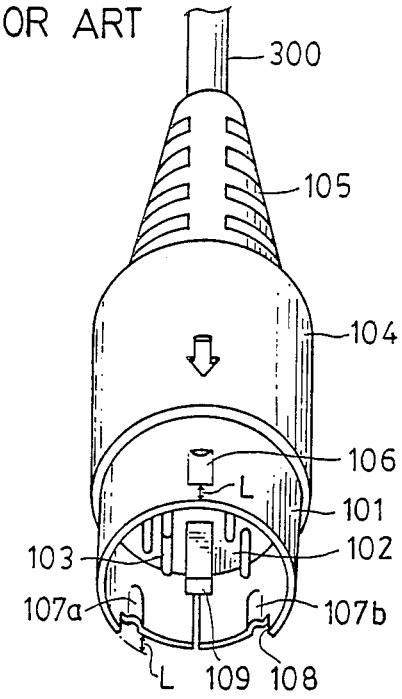
FIG. 1 PRIOR ART
FIG. 1 is a perspective view showing a prior art connector plug.
Figure 2:
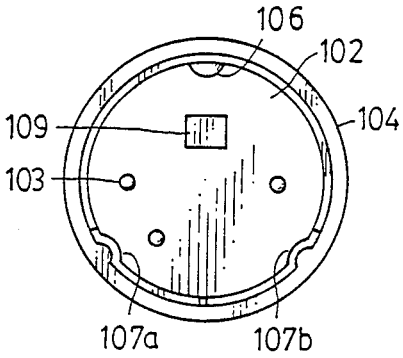
FIG. 2 PRIOR ART
FIG. 2 is a front view, to an enlarged scale, showing a prior art connector plug having three contact pins.
Figure 3:
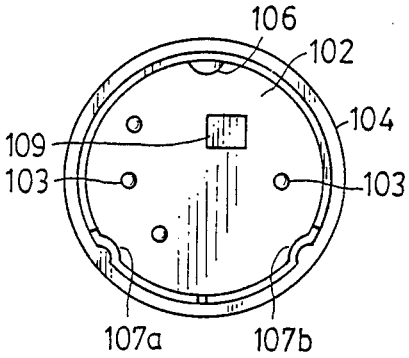
FIG. 3 PRIOR ART
FIG. 3 is a view similar to FIG. 2 but showing a prior art connector pin having four contact pins.
Figure 4:
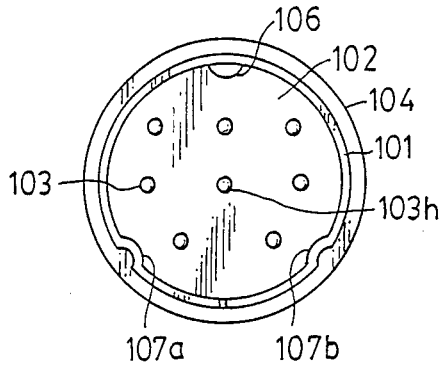
FIG. 4 PRIOR ART
FIG. 4 is a view similar to FIG. 4 but showing a prior art connector plug having eight pins.
Figure 5:
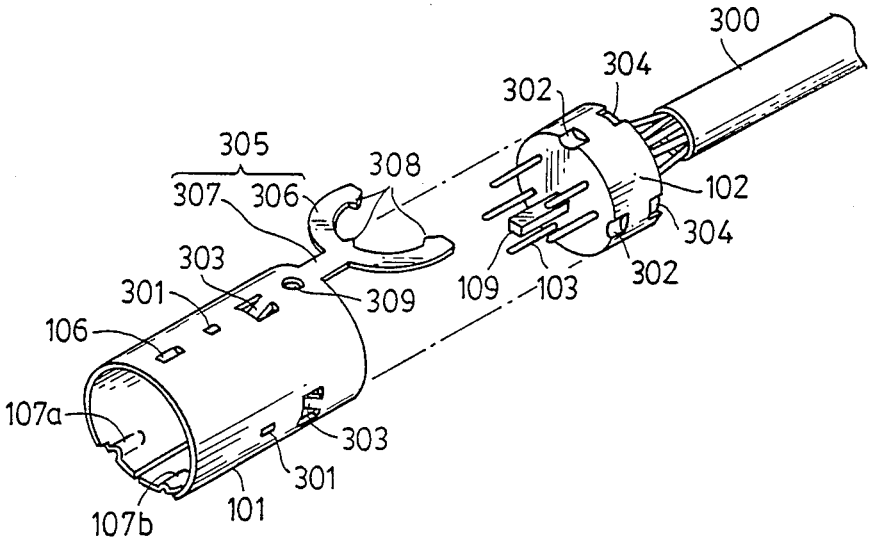
FIG. 5 PRIOR ART
FIG. 5 is a disassembled perspective view showing the internal structure of the prior art connector plug.
Figure 6:
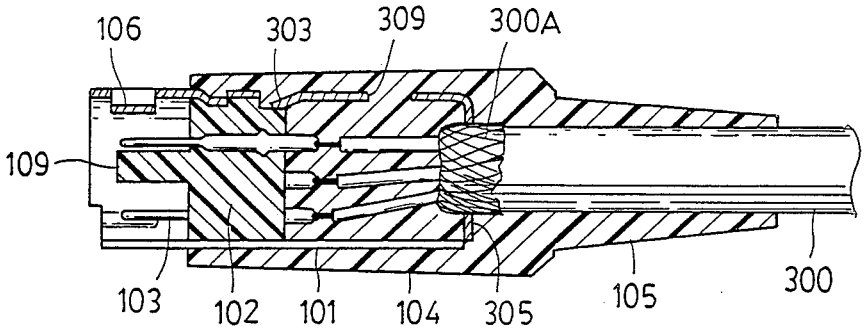
FIG. 6 PRIOR ART
FIG. 6 is an axial sectional view showing the prior art connector shown in FIG. 1.
Figure 7:
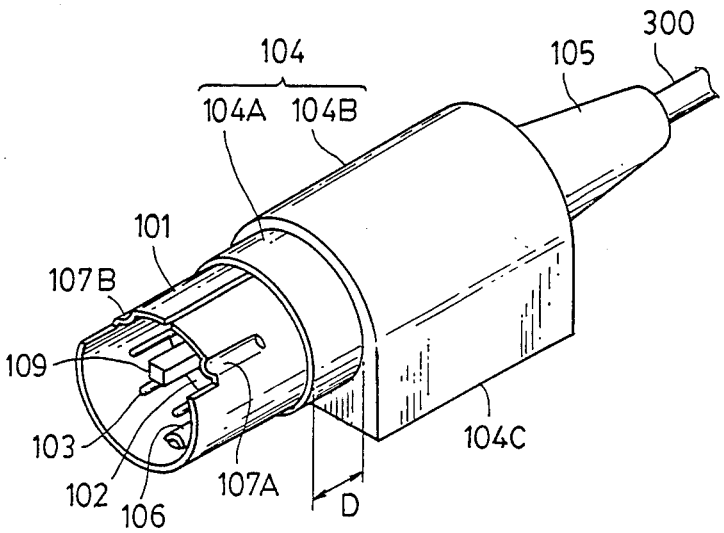
FIG. 7 is a perspective view showing an embodiment of the connector plug according to the invention.

FIG. 7 shows a perspective view of an embodiment of the connector plug according to the invention. Cylindrical metal cover 101, as in the prior art connector plug described above, is made by winding a resilient metal sheet into a cylindrical form so that opposite edges of the metal sheet come close to each other with a gap defined therebetween to permit displacement of said opposite edges in the diametrical direction. The structure of a front portion of the embodiment of the connector plug, like the prior art connector plug described above, has main positioning ridge 106 and auxiliary positioning ridges 107*a* and 107*b*. Insulating body 102 is accommodated in cylindrical metal cover 101 and has insulating bar-like member 109 and a plurality of contact pins 103. Insulating body 102, insulating bar-like member 109 and contact pins 103 are of the same structure as described before in connection with FIG. 5, so they are not described here in any detail.

Figure 9:
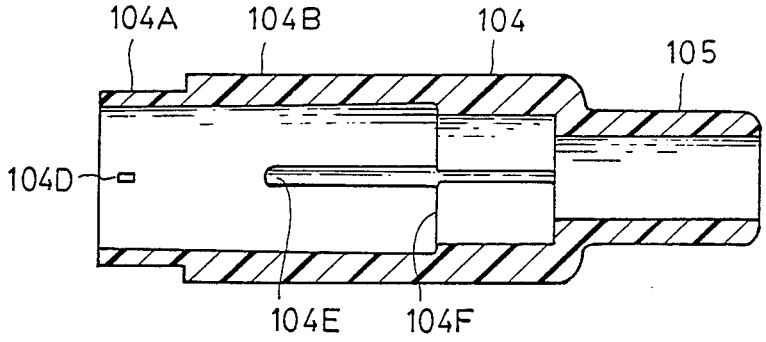
FIG. 9 is an axial sectional view perpendicular to FIG. 7 showing the insulating cap in a contracted-scale.
Figure 8:
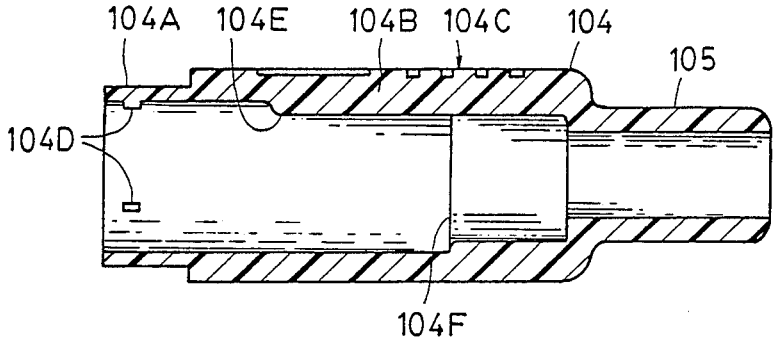
FIG. 8 is an axial sectional view, to a contracted scale, of the insulating cap shown in FIG. 7.
Figure 10:
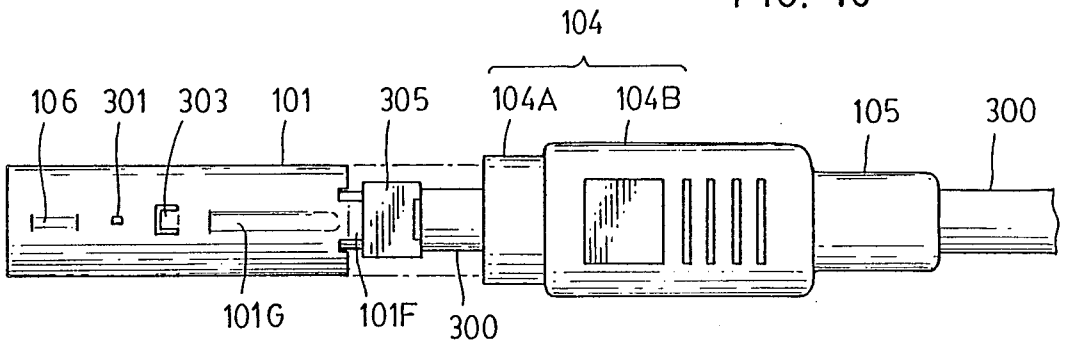
FIG. 10 is a side view showing the connector plug shown in FIG. 7 with the insulating cap removed.
Figure 12:
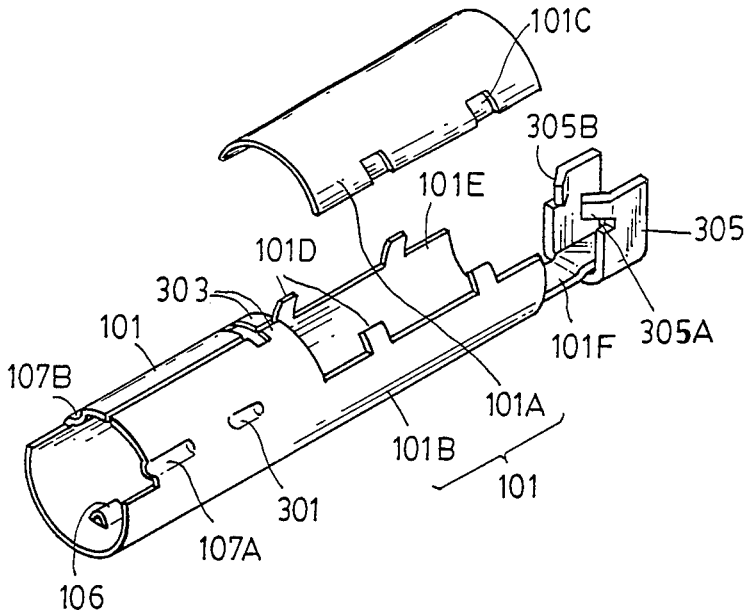
FIG. 12 is an exploded perspective view showing a cylindrical metal cover and a semi-cylindrical metal cover piece shown in FIG. 7.

This embodiment of the connector plug is different from the prior art connector plug as follows. A first difference is that the plug comprises a separately molded insulating cap 104, as shown in FIGS. 8 and 9. As shown in FIG. 10, insulating cap 104 is fitted on cylindrical metal cover 101 from the rear end thereof and covers metal cover 101 except for a front end portion thereof. A second difference is that cylindrical metal member 101, as shown in FIG. 12, has a semi-cylindrical rear portion 101B, which cooperates with a semi-cylindrical metal cover piece 101A. Before semi-cylindrical metal cover piece 101A is mounted, semi-cylindrical rear portion 101B of metal cover 101 provides large side opening 101E.

The structures of the individual components will now be described in detail.

Insulating cap 104, as shown in FIGS. 7 to 9, comprises a front, thin wall cylindrical portion 104A having a small outer diameter and a rear, thick wall body portion 104B having a large diameter. In this embodiment, body portion 104B of insulating cap 104 has a flat surface portion 104C constituting part of the outer periphery. Since the angular position of the flat surface portion 104C relative to the positioning ridges 107A, 107B is predetermined, it is easy to determine, by only feeling the flat surface portion, the present rotational position of the connector plug to be plugged into a mating socket.

With the stepped configuration of insulating body 104 consisting of large and small outer diameter portions, the large outer diameter portion, i.e., body portion 104B is usually gripped when holding the connector plug. Thus, even if a finger (not shown) is placed at the front end of body portion 104B, there is a gap between the finger and cylindrical metal cover 101 due to the difference in the outer diameter between body portion 104B and cylindrical metal cover 101, and this gap together with the existence of front thin wall portion 104A reduces the probability that the finger will directly touch cylindrical metal cover 101.

Figure 14:
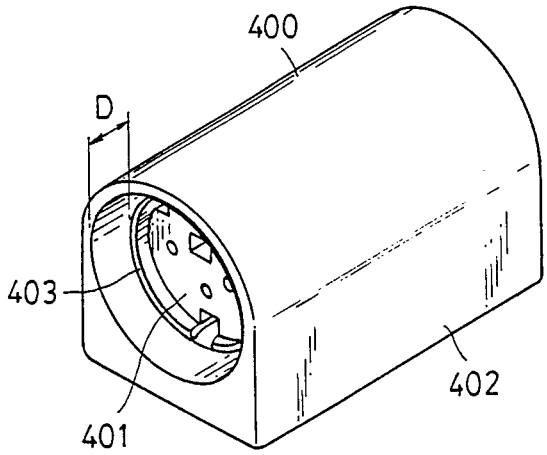
FIG. 14 is a perspective view showing a relay shield connector.

Further, this embodiment of the connector plug may be fitted for use in a relay shield connector 400 as shown in FIG. 14, for instance. Relay shield connector 400 has plug receptacle openings at the both opposite ends. Connector plugs according to the invention may be inserted into these plug receptacle openings, whereby cables connected to both the plugs are interconnected to interconnect two personal computers, for instance.

In this relay shield connector, the end of insulating body 401 supporting contacts is inwardly spaced by distance D from an open end of insulating cover 402. Distance D is substantially equal to length D of small outer diameter, thin wall cylindrical portion 104A of the connector plug (see FIG. 7), and portion 104A is engaged in the recessed portion of relay shield connector 400.

When a connector plug according to the invention connected to the relay shield connector having the aforementioned recessed portion, the conductive portion of the connector plug is not exposed to the outside at all. Therefore, there is no possibility of the external discharge of charge carried by a man or the like to cylindrical metal cover 101 of the connector plug. It is thus possible to steadily maintain the interconnection of personal computers, for instance.

FIG. 12 shows the structure of cylindrical metal cover 101 used for the connector plug according to the invention. Cylindrical metal cover 101 has a rear semi-cylindrical portion 101B. Semi-cylindrical metal cover piece 101A is engaged with semi-cylindrical portion 101B to complete the cylindrical form. Semi-cylindrical metal cover piece 101A has recesses 101C formed by pressing the outer surface adjacent to the opposite edges. Semi-cylindrical portion 101B has protuberances 101D provided at the opposite edges defining side opening 101E. Semi-cylindrical metal cover piece 101A is stably supported on semi-cylindrical portion 101B through engagement between recesses 101C and protuberances 101D.

When semi-cylindrical portion 101B is removed from semi-cylindrical metal cover piece 101A, large side opening 101E of semi-cylindrical portion 101E is exposed. In this state, insulating body 102 can be readily inserted into the cylindrical portion of cylindrical metal cover 101 through side opening 101E.

Figure 11:
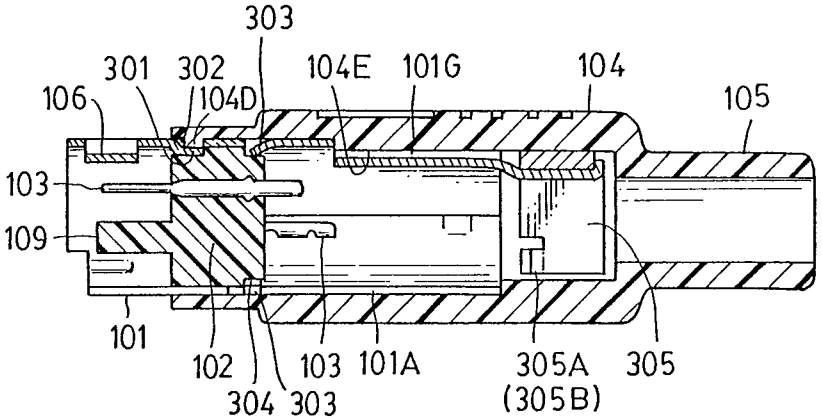
FIG. 11 is a contracted-scale axial sectional view showing the connector plug shown in FIG. 7.

FIG. 11 shows insulating body 102 fitted into cylindrical metal cover 101. Cylindrical metal cover 101, similar to the structure described before in connection with FIG. 5, has three protuberances 301 provided on the inner periphery thereof. Protuberances 301 are engaged in recesses 302 formed in insulating body 102 (see FIGS. 5). Further, like the prior art structure, insulating body 102 is retained against detachment by inwardly bent portions 303.

As shown in FIGS. 8 and 9, insulating body 104 is retained against detachment through the engagement of three protuberances 104D provided on its inner peripheral surface, with recesses defined by the opposite side of protuberances 301 on the outer periphery of cylindrical metal cover 101.

As shown in FIGS. 8 and 9, the inner periphery of insulating cap 104 is provided with axial ridge 104E. Also, as shown in FIG. 10, the outer periphery of cylindrical metal cover 101 is formed with axial groove 101G. As shown in FIG. 11, ridge 104E and groove 101G are engaged with each other to prevent rotation of cylindrical metal cover 101 and insulating cap 104 relative to each other.

Figure 13:
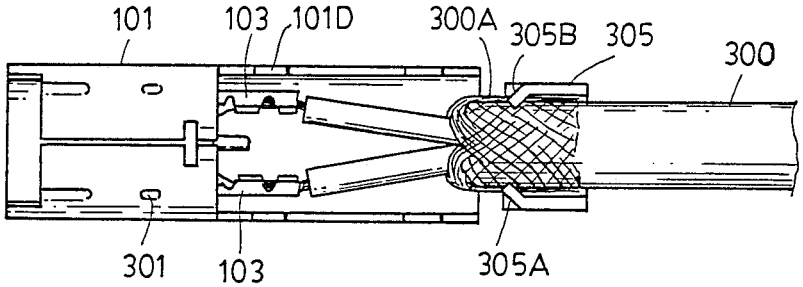
FIG. 13 is a bottom view, showing the connector plug shown in FIG. 10 with the insulating cap removed.

Cylindrical metal cover 101, as shown in FIGS. 10, 12 and 13, has rearward extension 101F, to which cable clamp member 305 is secured. Cable clamp member 305 is made of a metal sheet, which is thicker than the metal sheet constituting cylindrical metal cover 101 and has sufficient mechanical strength. Cable clamp member 305 is substantially U-shaped, and its intermediate portion is welded to the end of rearward extension 101F. U-shaped cable clamp member 305 has inwardly bent pawl portions 305A and 305B formed at the upper end of the edge of the two legs on the side of cylindrical metal cover 101. When the two legs of cable clamp member 305 are inwardly bent against cable 300, pawl portions 305A and 305B wedge into the insulating sheath of cable 300, as shown in FIG. 13, whereby cable 300 is clampedly held by cable clamp member 305. Before clamping cable 300, shield braid 300A extending from the end of cable 300 is folded back onto the outer sheath of cable 300. Then, cable 300 is clamped with cable clamp member 305 from above the folded shield braid. In this way, shield braid 300A of cable 300 and cylindrical metal cover 101 are electrically connected to each other.

As has been described in the foregoing, in addition to the functional advantages obtainable with the prior art connector plug shown in FIGS. 1 to 6, the following functional advantages are obtained in the present invention.

(a) Since the rear portion of cylindrical metal cover 101 is formed as semi-cylindrical portion 101B, which cooperates with semi-cylindrical metal cover piece 101A, insulating body 102 can be easily installed in the interior of cylindrical metal cover 101 through side opening 101E of the rear portion of cylindrical metal cover 101A, which side opening 101E is exposed by removing semi-cylindrical metal cover piece 101A from the rear portion of cylindrical metal cover 101B. Also, since the front portion of the metal cover 101 is formed by bending a resilient metal sheet into a cylindrical form, the cylindrical metal cover 101 can resiliently engage an annular contact 403 of a mating socket shown in FIG. 14 thus increasing the engaging force in cooperation with the annular contact as in the case of cylindrical metal cover 101 of the prior art connector plug shown in FIG. 1.

After insulating body 102 has been installed, semi-cylindrical metal cover piece 101A is engaged with the rear portion of cylindrical metal cover 101, assembling into the cylindrical form. Insulating cap 104 is then slid into place to cover cylindrical metal cover 101 substantially over the entire length thereof. Thus, even if insulating cap 104 has a small wall thickness, it will not be deformed by external forces. It is thus possible to provide a connector plug, which is small in size and has high durability.

(b) According to the invention, the assembly is completed by electrically connecting the wires of cable 300 to contact pins 103 extending from insulating body 102, then installing insulating body 102 in cylindrical metal cover 101 through side opening 101E, then clamping cable 300 with cable clamp member 305 and fitting insulating cap 104 on the rear portion of cylindrical metal cover 101.

Thus, the process for assembling various parts of the connector plug does not include resin molding of insulating cap 104. The connector plug thus can be easily assembled. Particularly, the manufacture can be simplified since insulating cap 104 can be formed separately.

(c) Further, since insulating cap 104 is fitted on cylindrical metal cover 101, repair can be made by removing insulating cap 104 in the case of occurrence of electric disconnection between cable 300 and contact pins 103. It is thus possible to improve the production yield.

(d) Further, since insulating cap 104 has the stepped configuration consisting of a small outer diameter, thin wall portion 104A covering only a front end portion of cylindrical metal cover 101 and a large outer diameter, thick body portion 104B, the possibility that cylindrical metal cover 101 will be touched by a finger of the user when the connector plug is gripped can be reduced.

Thus, it is possible to reduce the possibility that electric charge on a user will be discharged to cylindrical metal cover 101, thus reducing the possibility of adversely affecting the apparatus connected to the connector plug.

(e) Further, since cable clamp member 305 is made of a material having a greater thickness than the metal sheet of cylindrical metal cover 101 and is formed with pawl portions 305A, 305B wedging in cable 300, it is possible to provide a strong force with which to clamp cable 300.

We claim:

1. A connector plug comprising:

an insulating body;

a plurality of contact pins carried by said insulating body, each of said contact pins having a contact portion and a terminal portion extending respectively from front and rear ends of said insulating body;

a cylindrical metal cover comprising a rolled resilient metal sheet the opposite edges of which are disposed closely adjacent to each other, said cylindrical metal cover having a semi-cylindrical rear portion defining a side opening extending rearwardly to merge into a rear opening of said cylindrical metal cover, said insulating body being disposed in said cylindrical metal cover with said contact pins extending through said insulating body inside said cylindrical metal cover in an axial direction thereof;

a semi-cylindrical metal cover piece detachably mounted on said cylindrical metal cover to close said side opening and cooperating with said semi-cylindrical rear portion of said cylindrical metal cover to form a cylinder;

said terminal portions of said contact pins being disposed inside said semi-cylindrical metal cover piece and said semi-cylindrical rear portion of said cylindrical metal cover for connection to respective wires of a cable;

a cable clamp means made of a metal sheet that is thicker than the metal sheet in said cylindrical metal cover, said cable clamp means being affixed to the rear end of said semi-cylindrical rear portion of said cylindrical metal cover for clamping said cable; and a separately molded insulating cap formed of a resin material, said insulating cap being positioned to cover said cylindrical metal cover, said semi-cylindrical metal cover piece, and said cable clamp means while exposing a front end portion of said cylindrical metal cover, said insulating cap extending rearwardly to define a cable protector portion.

* * * * *